US006761180B1

(12) United States Patent
Lai

(10) Patent No.: US 6,761,180 B1
(45) Date of Patent: Jul. 13, 2004

(54) DUAL DIRECTION-SWINGING DEVICE FOR AN UMBRELLA

(76) Inventor: Jin Sheng Lai, PMB #1008, 1867 Ygnacio Valley Rd., Walnut Creek, CA (US) 94598

( * ) Notice: Subject to any disclaimer, the term of this patent is extended or adjusted under 35 U.S.C. 154(b) by 0 days.

(21) Appl. No.: 10/393,470

(22) Filed: Mar. 21, 2003

(51) Int. Cl.[7] ..... A45B 11/00
(52) U.S. Cl. ..... 135/20.3; 135/20.1
(58) Field of Search ..... 135/20.1, 20.3, 135/21, 16

(56) References Cited

FOREIGN PATENT DOCUMENTS

CA 685492 * 4/1964

* cited by examiner

*Primary Examiner*—Leslie A. Braun
*Assistant Examiner*—Kofi Schulterbrandt
(74) *Attorney, Agent, or Firm*—Leong C. Lei

(57) ABSTRACT

A dual direction-swinging device for an umbrella, which comprises a hollow shaft, rib and an umbrella panel mounted onto the top of the rib, characterized in that the shaft is provided with a rolling device interlinked to the rib and the direction-swinging device having a seat, a swinging head and a triggering mechanism, the trigger device is within the seat and has two fixing plates having a first fixing hole and a second fixing hole, a worm gear having two ends mounted with a pivot shaft mounted the two fixing plate to the first fixing hole; a worm gear with a wheel shaft having a lathering face, the tangential face of the hole is corresponding to the lathering face for mounting, an umbrella shape gear is coupled to the lower section of the conic shape gear to receive the rotating force transmitted from the rolling device, the worm gear and the umbrella gear are coupled, and the umbrella gear and the gear section at the bottom end of the swinging head are coupled so that the umbrella panel can be adjusted to swing in all direction.

13 Claims, 13 Drawing Sheets

DUAL DIRECTION-SWINGING DEVICE FOR AN UMBRELLA

BACKGROUND OF THE INVENTION (a) Technical Field of the Invention

The present invention relates generally to a structure of an umbrella, and in particular, an improved structure of an umbrella having dual-direction swinging device allowing the umbrella panel to swing to the left and right side without self-folding even a strong wind is blowing.

(b) Description of the Prior Art

FIG. 13. is an exploded perspective view of a folding device for direction swinging of a conventional umbrella. The pivotal position is at a higher position and therefore two hands of a user are needed to operate the umbrella, which is not convenient and laborious.

Conventional tilting umbrella has a shaft with a notch on which it is pivoted the ribs which support the cover. The ribs themselves are held up, in the erected position of the umbrella, by a corresponding number of stretchers attached pivotally at one end to the ribs. The runner slides along the shaft in order to fold and unfold the umbrella. In the upper position of the runner, with the umbrella unfolded, the runner is held in place by a catch. In order to provide the required tilting facility for the umbrella, a joint is provided in the shaft at a point below the upper position of the runner. The arrangement allows the head of the umbrella to tilt with respect to the shaft, but there are a number of disadvantages, most notably that, during folding and unfolding of the umbrella, the runner tends to catch on the joint. The presence of a tilting joint in the shaft also allows play in the umbrella, and the fact that the entire head of the umbrella, from the tilting joint upwards, is inclined when the tilt facility is used, means that the center of gravity of the umbrella is displaced some way off the shaft axis, leading to instability and difficulties in handling especially in windy conditions. Further, the joint itself must fit within the confines of the shaft diameter, since the runner has to pass over it to fold and unfold the umbrella. This limits both the strength and the configuration of the joint.

Another conventional "head-tilt" frame, has a tilting joint located at a position between the top of the shaft and the runner. This means among other things that the joint can be much more robust than previously, and also that various kinds of joints, which otherwise would be unsuitable for umbrella frames, are now available for use. Other conventional frame has proven highly successful, it still has a minor weakness in that the tilt joint can be activated unintentionally by strong winds, even if the ball-and-socket joint has retaining lugs to keep the shaft straight.

SUMMARY OF THE INVENTION

Accordingly, it is an object of the present invention to provide a dual direction-swinging device for an umbrella having a hollow shaft, rib and an umbrella panel mounted onto the top of the rib, characterized in that the shaft is provided with a rolling device interlinked to the rib and the direction-swinging device having a seat, a swinging head and a triggering mechanism, the seat includes a slot and a hole through the slot, the swinging head is engaged with the slot, the bottom end of the swinging head is provided with teeth-like section which can be pivotally mounted with a peg, the trigger device is within the seat and has two fixing plates having a first fixing hole and a second fixing hole, the two fixing plates are mounted to the seat with a fixing element; a worm gear having two ends mounted with a pivot shaft mounted the two fixing plate to the first fixing hole; a worm gear with a wheel shaft having a lathering face and is mounted with a conic shape gear having a tangential hole, the tangential face of the hole is corresponding to the lathering face for mounting, and the two ends of the worm gear are provided with a pivotal shaft for fixing to the second fixing hole, an umbrella shape gear is coupled to the lower section of the conic shape gear to receive the rotating force transmitted from the rolling device, the worm gear and the umbrella gear are coupled, and the umbrella gear and the gear section at the bottom end of the swinging head are coupled so that the umbrella panel can be adjusted to swing in all direction.

Yet a further object of the present invention is to provide a dual direction-swinging device for an umbrella, wherein a collar is positioned between the umbrella gear and the transmission shaft and the collar is secured at the recess of the cord protection seat, and a peg is disposed to the umbrella gear for mounting to the end of the transmission shaft.

Still another object of the present invention is to provide a dual direction-swinging device for an umbrella, further comprises a seat body linked with the umbrella shaft and having a rotating section provided with an interlinking section, and the rotating section drives the interlinking section and the shaft of the rotating section is connected with a pulling cord to unfolding the umbrella panel.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
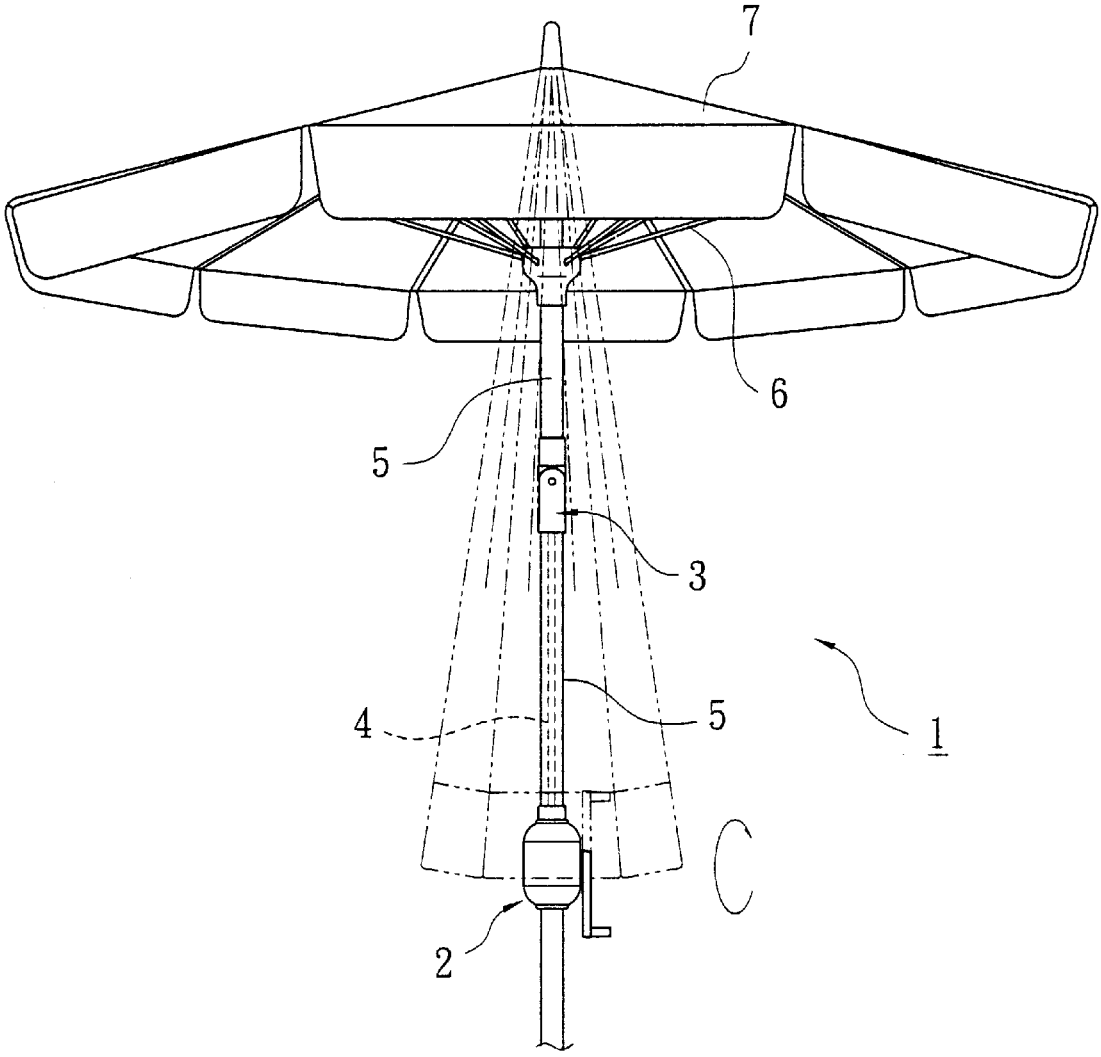
FIG. 1 is a schematic view showing the folding and unfolding of an umbrella in accordance with the preferred embodiment of the present invention.
Figure 2:
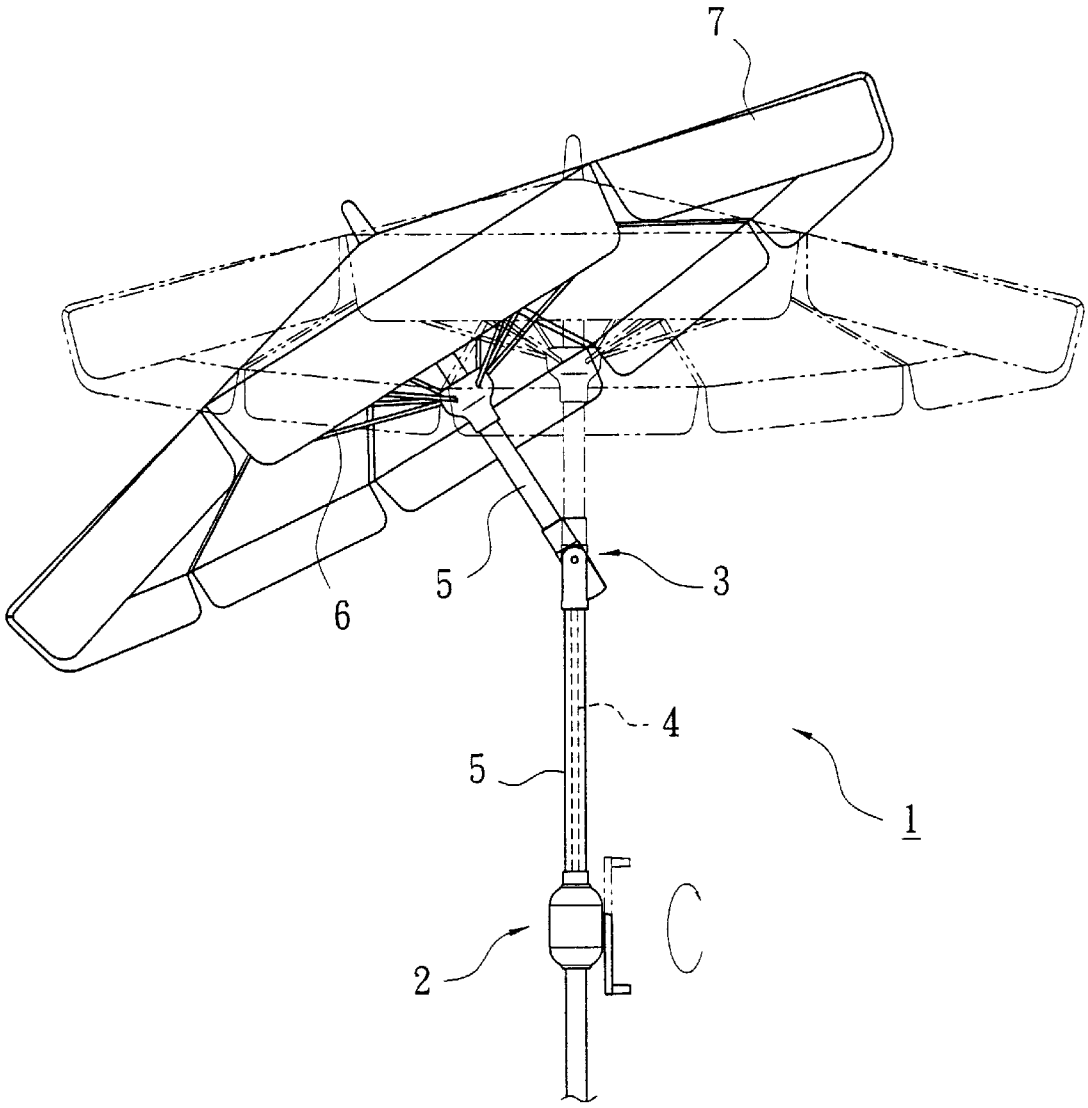
FIG. 2 is a schematic view showing the swinging of the umbrella of the present invention.

Referring to FIGS. 1 and 2, there is shown a dual direction-swinging device for an umbrella 1 having a rolling device 2, a direction-swinging device 3 and a transmission shaft 4 within an umbrella shaft 5. The umbrella panel 7 of the umbrella 1 is folded or unfolded by the rolling device 2 operated by a handle. When the handle is pulled outward a distance from the rolling device 2, the transmission shaft 4 interlinks with the direction-swinging device 3 so that the umbrella panel 7 can turn to bend left or right direction (within 23 degree, as shown in FIG. 2).

Figure 3:
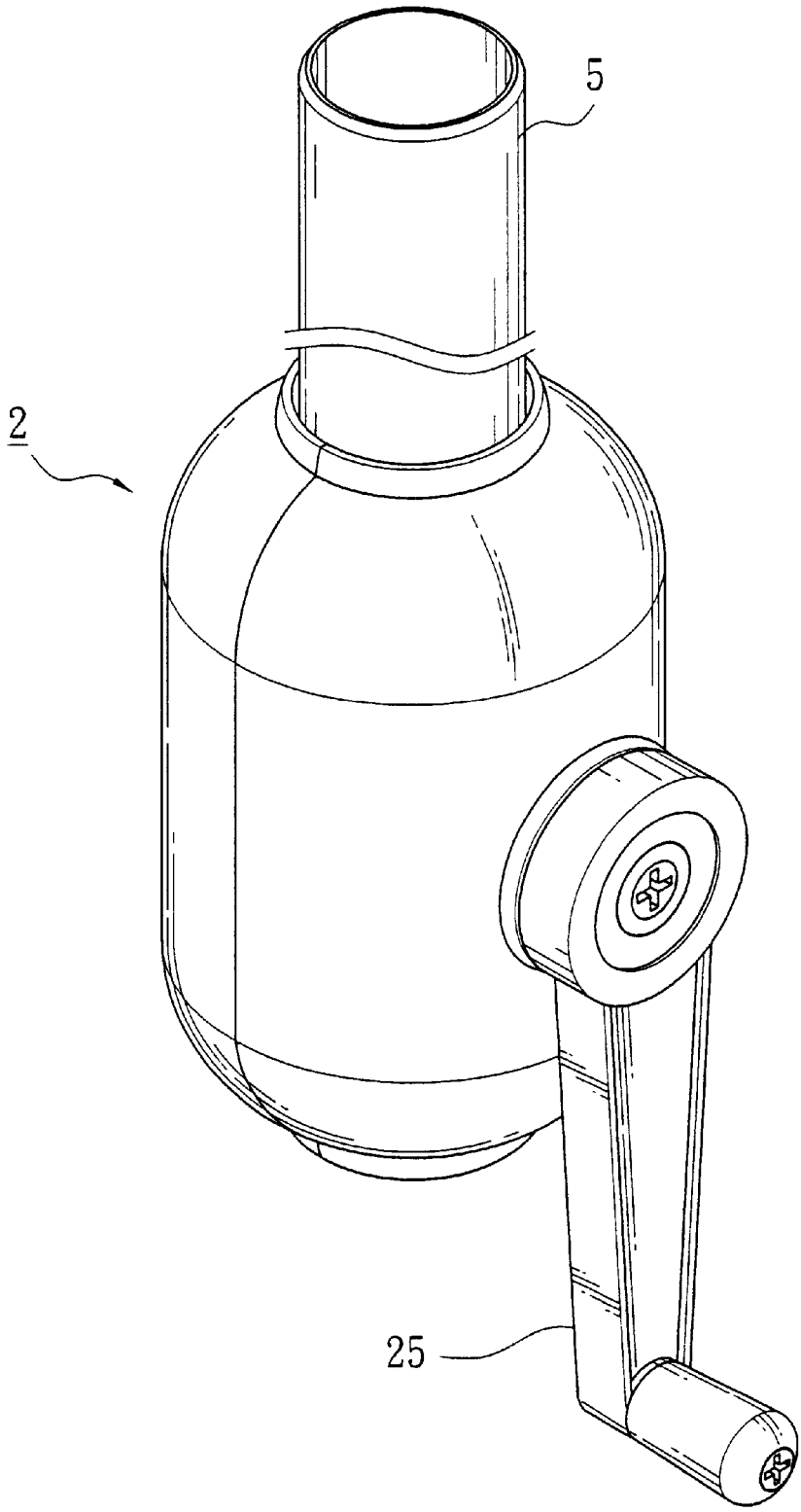
FIG. 3 is a perspective view of the direction-swinging device of the present invention.
Figure 4:
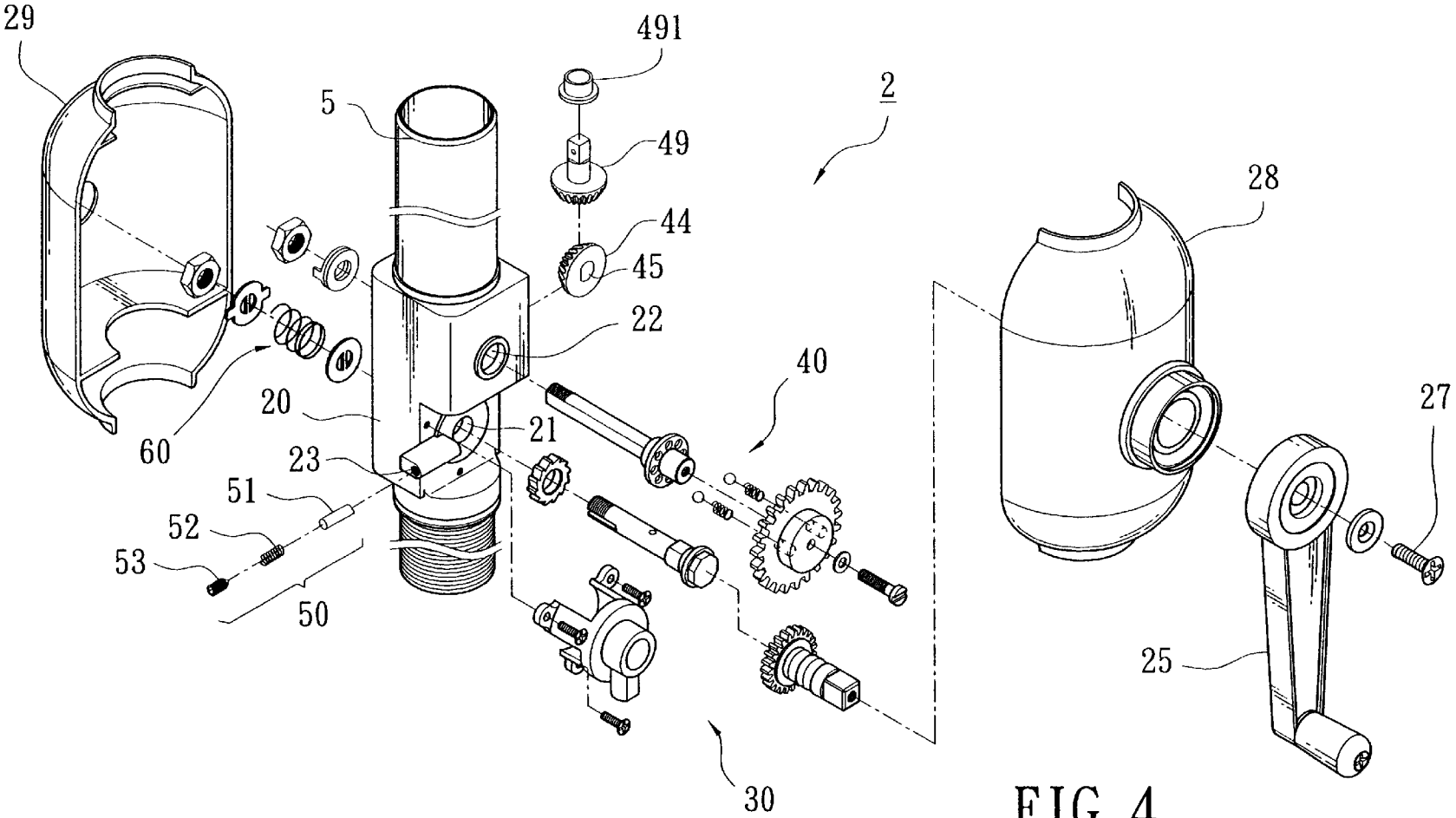
FIG. 4 is a perspective exploded view of the rolling device of the present invention.

The umbrella 1 comprises a hollow shaft 5, and a stretcher 6 and a panel 7. As shown in FIGS. 3 and 4, the rolling device 2 positioned at a predetermined height of the umbrella shaft 5 and the rolling device 2 includes a seat body 20, a transmission section 30 and an interlinking section 40, the seat body 20 linked with the umbrella shaft 5 and having a rotating section 30 provided with an interlinking section 40. The rotating section 30 drives the interlinking section 40 and the shaft of the rotating section 30 is connected to a pulling cord 8 to unfolding the umbrella panel 7. The seat body 20 is provided with a first through hole 21, a second through hole 22 for pivotal mounting with the rotating section 30 and the interlinking section 40, and the first through hole 21 near to the seat body 20 is provided with a long hole 23 having a stopping section 50. The stopping section 50 includes a ratchet finger 51, a blocking block 53, and an elastic element 52 positioned between the ratchet finger 51 and the blocking block 53.

Figure 12:
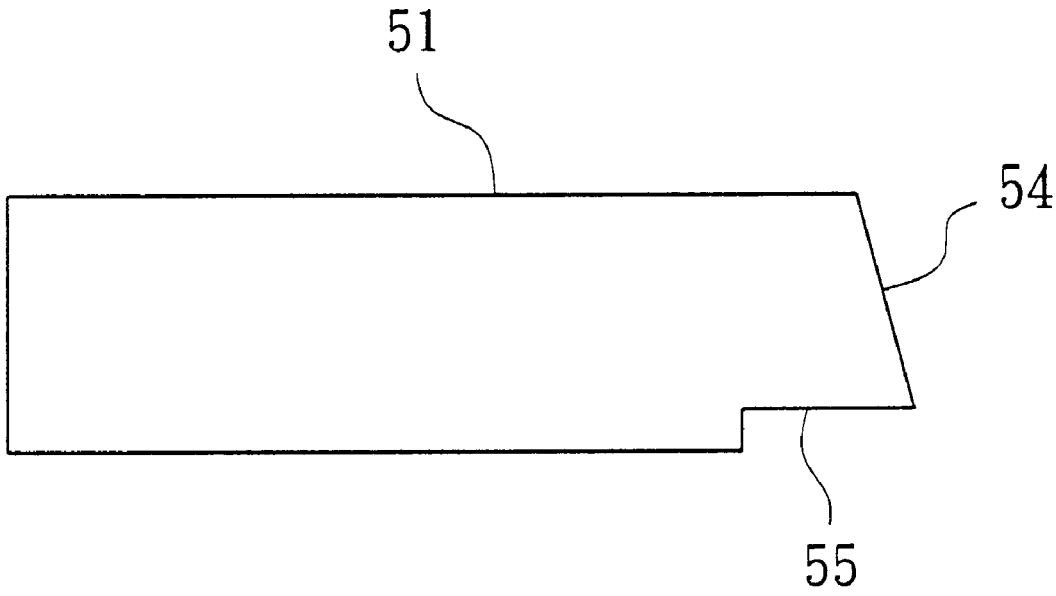
FIG. 12 is a lateral view of the ratchet finger of the present invention.
Figure 13:
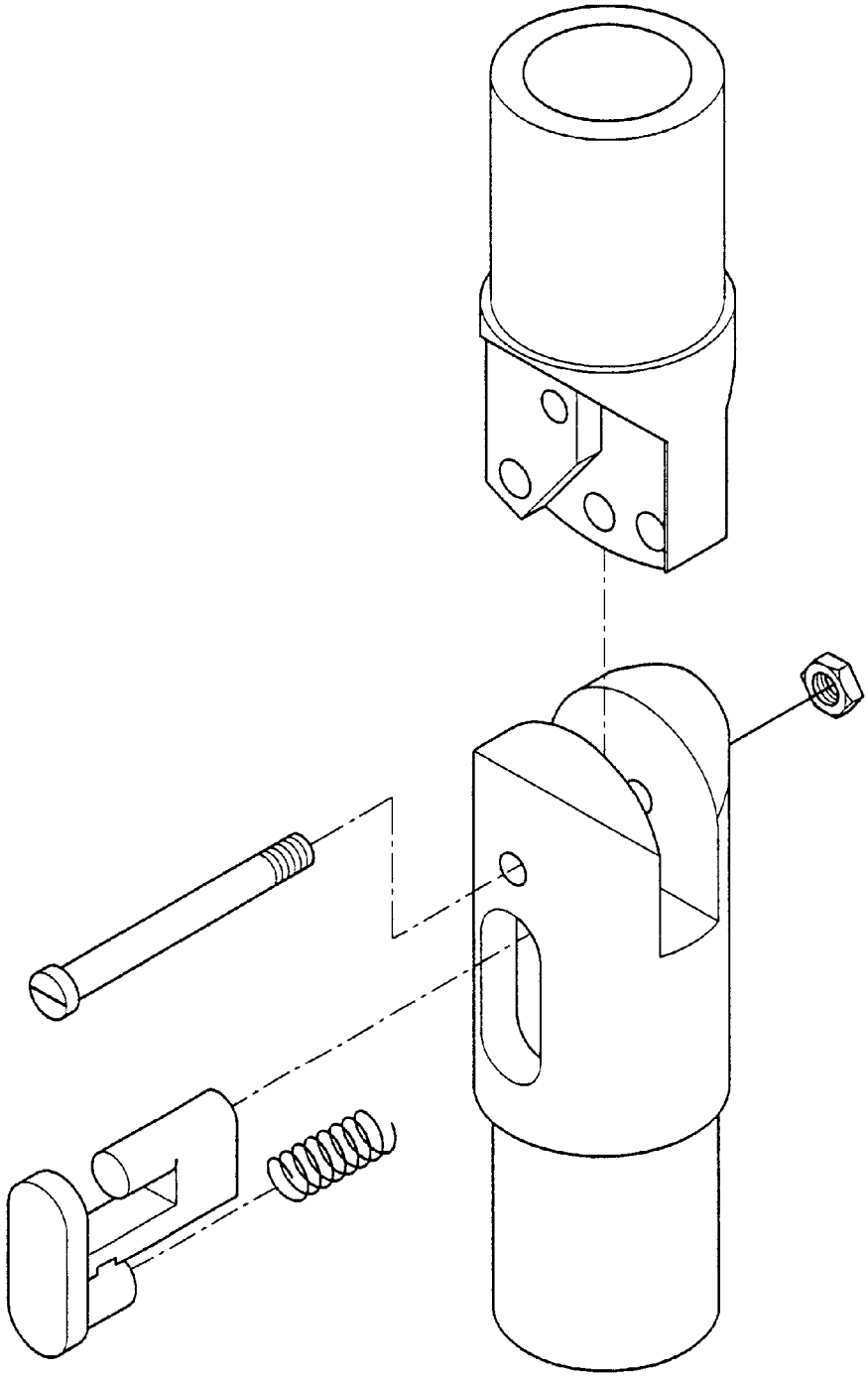
FIG. 13 Prior Art
FIG. 13 is a perspective view of a conventional direction-swinging device.

Referring to FIG. 12, the ratchet finger 51 is a circular rod and one end thereof is provided with a slanting face 54. The end face of the slanting face 54 is a positioning flat face 55.

Figure 9:
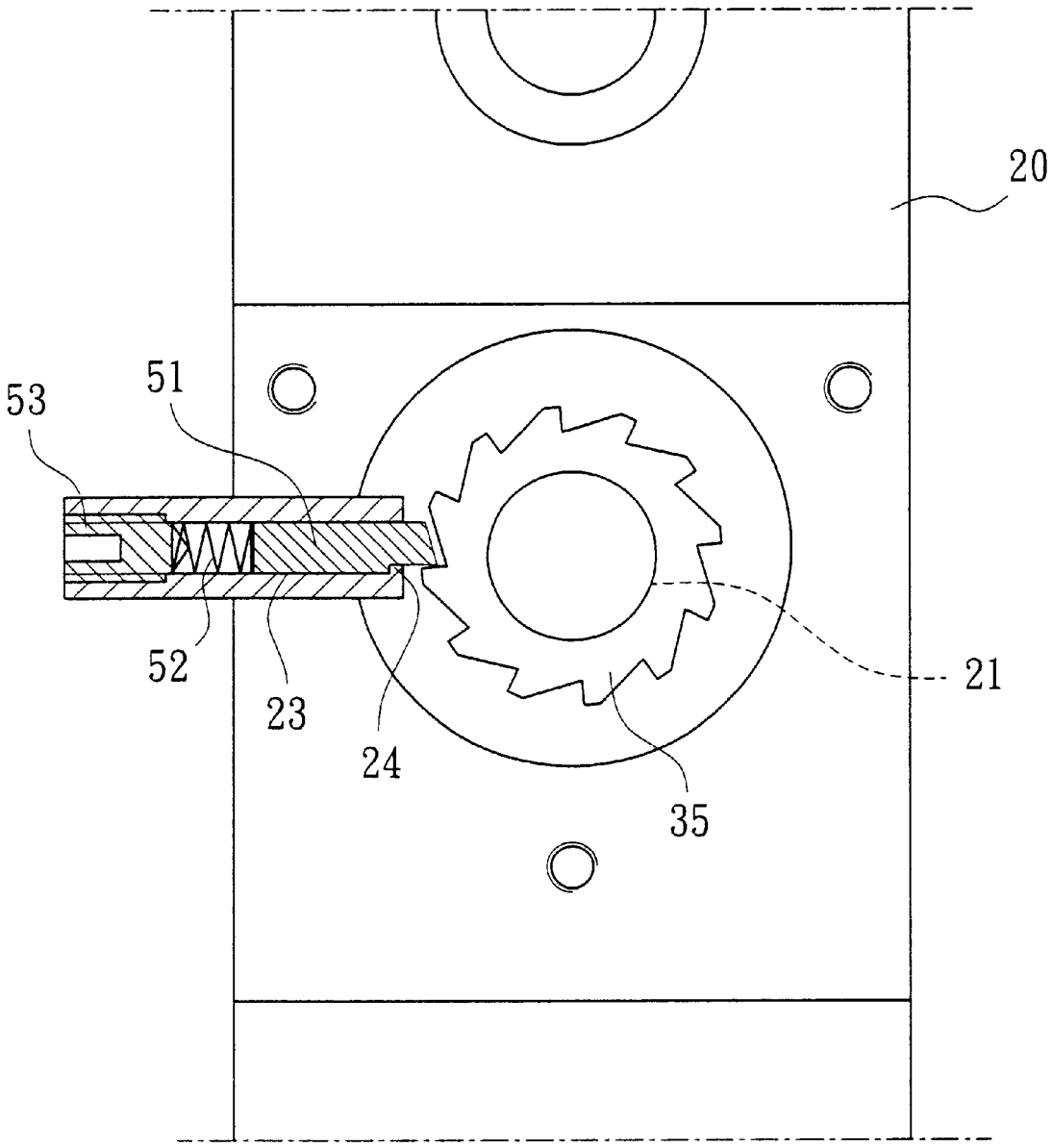
FIG. 9 is a sectional view showing the stopping section in accordance with the present invention.

As shown in FIG. 9, the long hole 23 is provided with a tapered step 24 and the ratchet finger 51 and the spring 52 are positioned within the long hole 23. The positioning flat face 55 and the tapered step 24 are in engagement and the end is fixed with a blocking block 53. Thus the slanting face 54 urges the teeth face of the single direction ratchet wheel 35 to provide a stopping function.

Figure 5:
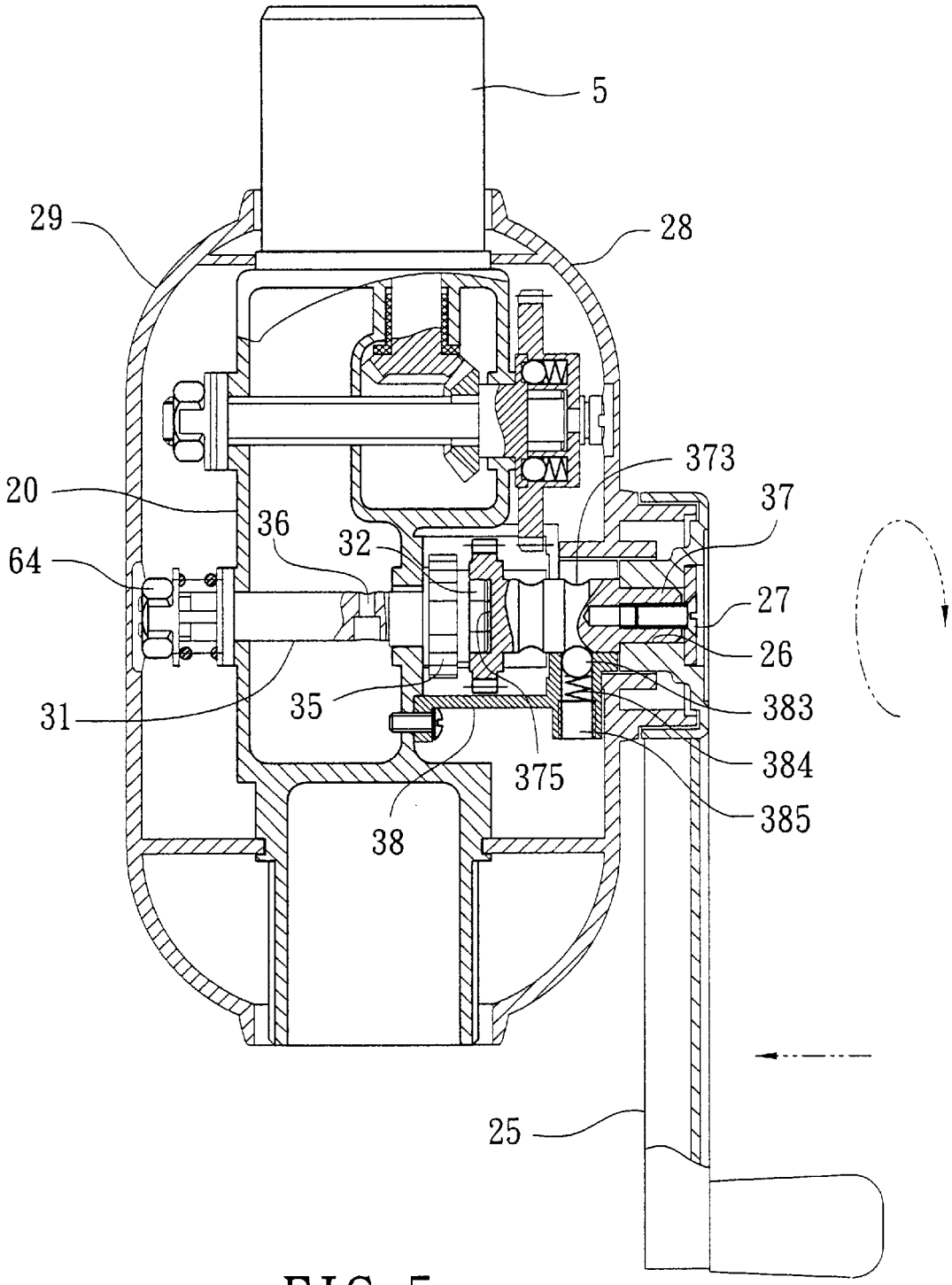
FIG. 5 is a sectional view of the rolling device showing the rotating of the handle to elevate or lower the umbrella panel of the present invention.
Figure 10:
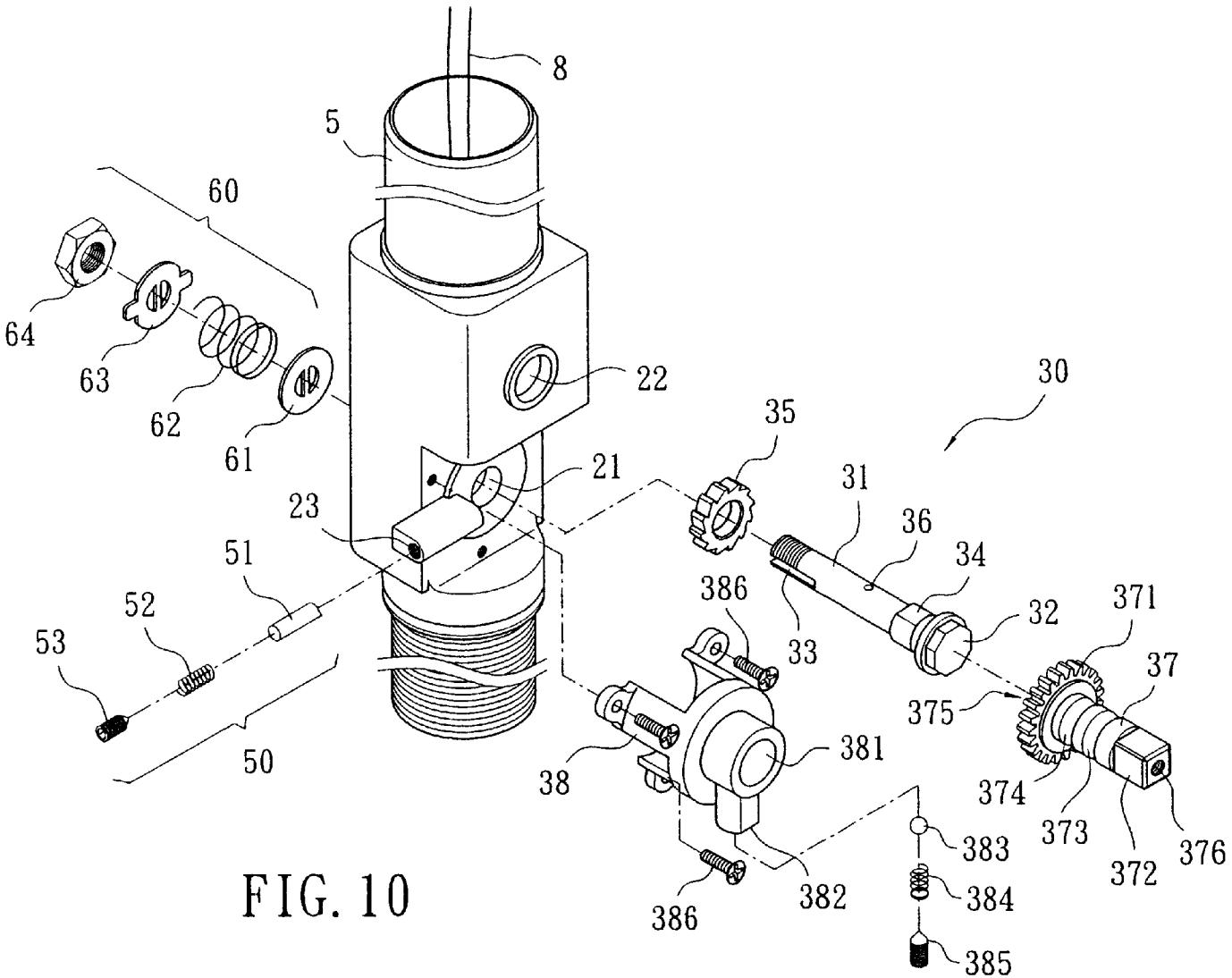
FIG. 10 is a schematic view showing the rotating section structure of the rolling device of the present invention.

As shown in FIGS. 4, 5 and 10, a shaft 31 pivotally mounted to the seat body 20 and having one end provided with a protruded section 32. The protruded section 32 is a non circular face, the other end of the shaft 31 is provided with a slot 33, and the protruded section 32 is provided with a connecting section 34 having a single direction ratchet wheel 35, and the shaft 31 is provided with a cord hole 36 for mounting with a pulling cord 38 connected to the umbrella stretcher 6. A clutch shaft 37 is provided with a gear 371 with one end face extended to form a shaft center mounted with a first recess 373 and a second recess 374, the other end face of the gear 371 is provided with a protruded section 32 to match with a recessed section 375. The end face of the shaft center is provided with a screw hole 376.

A positioning seat 38 has one end provided with a through hole 381 for the passing through the shaft center of the clutch shaft 37, and the circumferential edge of the through hole 381 is provided with a long hole 382 provided with a positioning element to urge the first recess 373, as shown in FIG. 4 and the second recess 374 of the shaft center of the clutch shaft 37, as shown in FIG. 5. The positioning seat 38 is in combination with screws 386 mounted to the seat body 20.

The long hole 382 is filled with steel balls 383 to urge at the first recess 373 and the second recess 374.

Referring to FIGS. 4 and 10, a delaying section 60 comprises a pad 61, a spring 62, a stopping pad 63 and a screw nut 64. The center of the pad 61 and the stopping pad 63 is an isolation plate and the pad 61 and the stopping pad 63 are mounted to the recess 33 of the shaft 31 by the isolation plate. The screw nut 64 is mounted the pad 61, the elastic element (the spring) 62 and the stopping pad 63 are mounted onto the recess 33 of the shaft 31.

As shown in FIGS. 4, 5, and 10, a handle 25 is provided with a hole 26 for mounting with the shaft section 372 of the clutch shaft 37 and a bolt 27 is inserted so as to mount the handle 25 at the end section of the shaft center. The handle 25 can be rotated and the parts within the two housing bodies 28, 29 can be driven by the handle 25.

The housing bodies 28, 29 are mounted at the external of the seat body 20 and comprise two external shells 28,29, one of the shells being provided with a cap body having a corresponding hole for the extension out of the shaft center of the clutch shaft 37.

Figure 6:
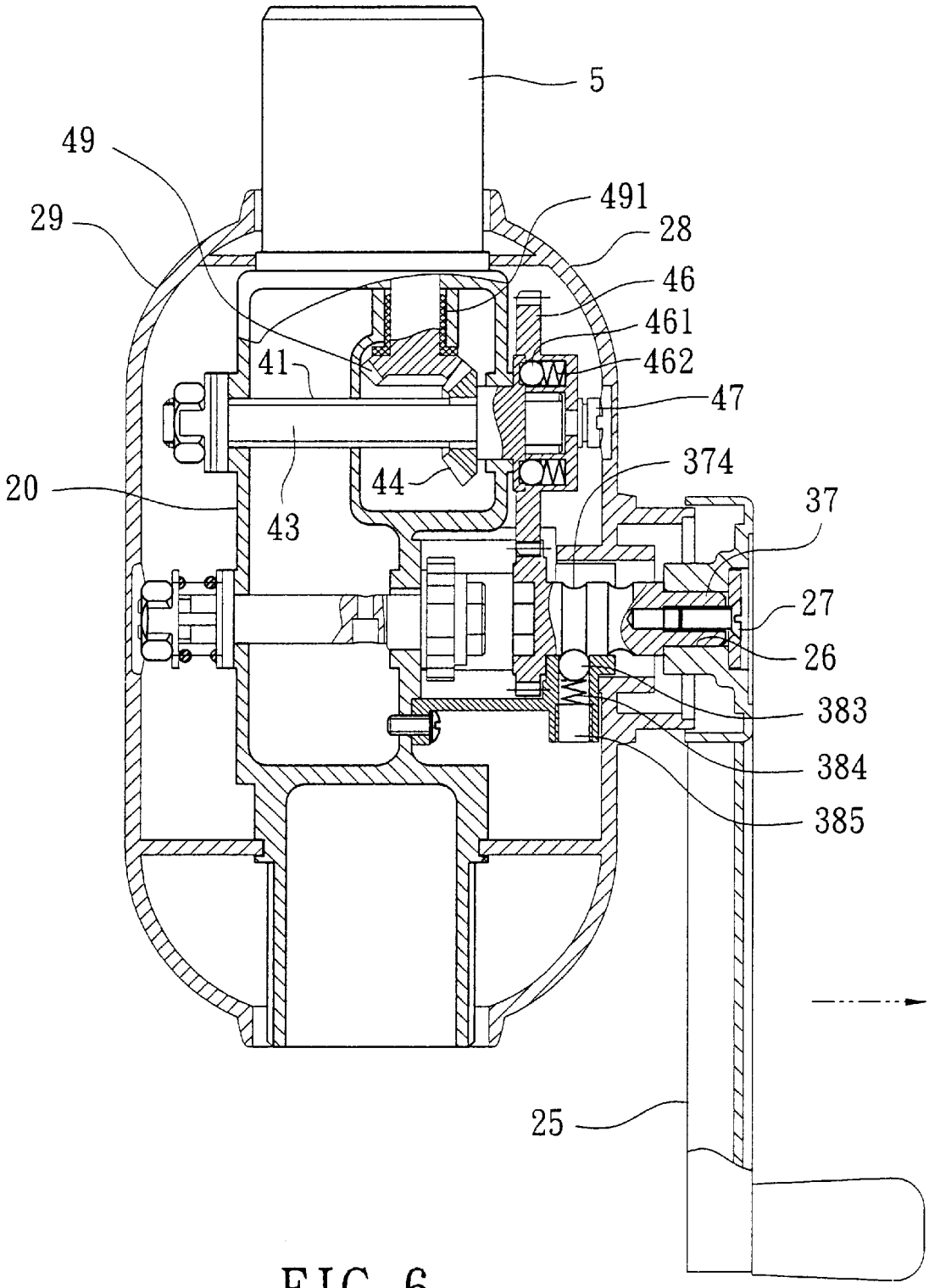
FIG. 6 is a sectional view of the rolling device showing the rotating of the handle to cause a swinging of the umbrella panel of the present invention.
Figure 11:
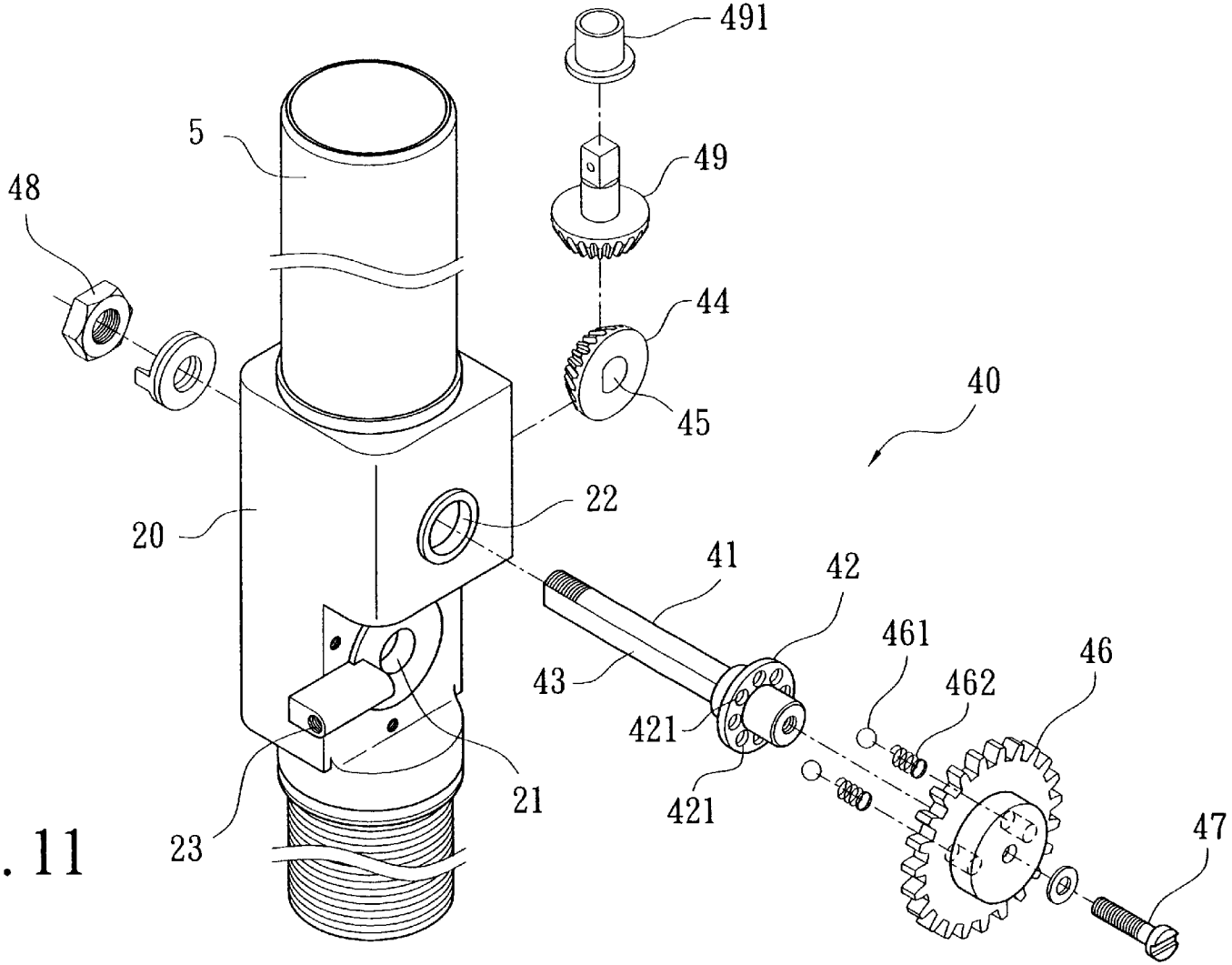
FIG. 11 is a schematic view showing the interlinking section structure of the rolling device of the present invention.

As shown in FIGS. 4, 6, and 11, the interlinking shaft 41 is mounted to the seat body 20 and one end thereof having a fixing section with a protruded edge 42, the side of the protruded edge 42 being a plurality of recesses 421 and the interlinking shaft 41 having a lathering face 43, and the interlinking shaft 41 mounted onto a conic gear 44 having a tangential hole 45 which corresponds to the lathering face 43 of the interlinking shaft 41.

An interlinking gear 46 includes a screw nut 48 mounting to the interlinking shaft 41, and the protruded edges 42, the interlinking gear 46 and the interlinking shaft 41 enclose steel balls 461 and spring 462.

Figure 7:
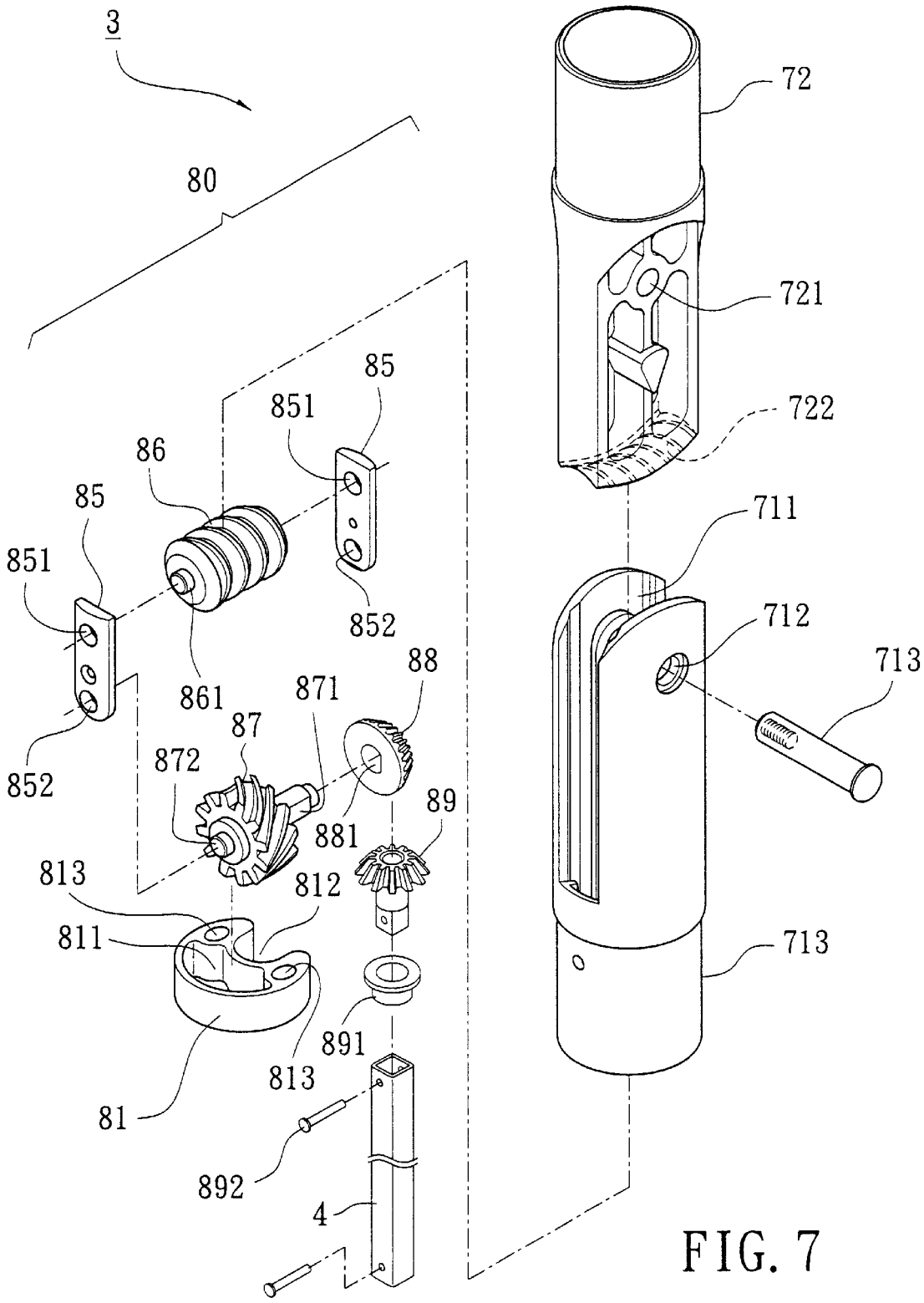
FIG. 7 is a perspective exploded view of the direction-swinging device of the present invention.
Figure 8:
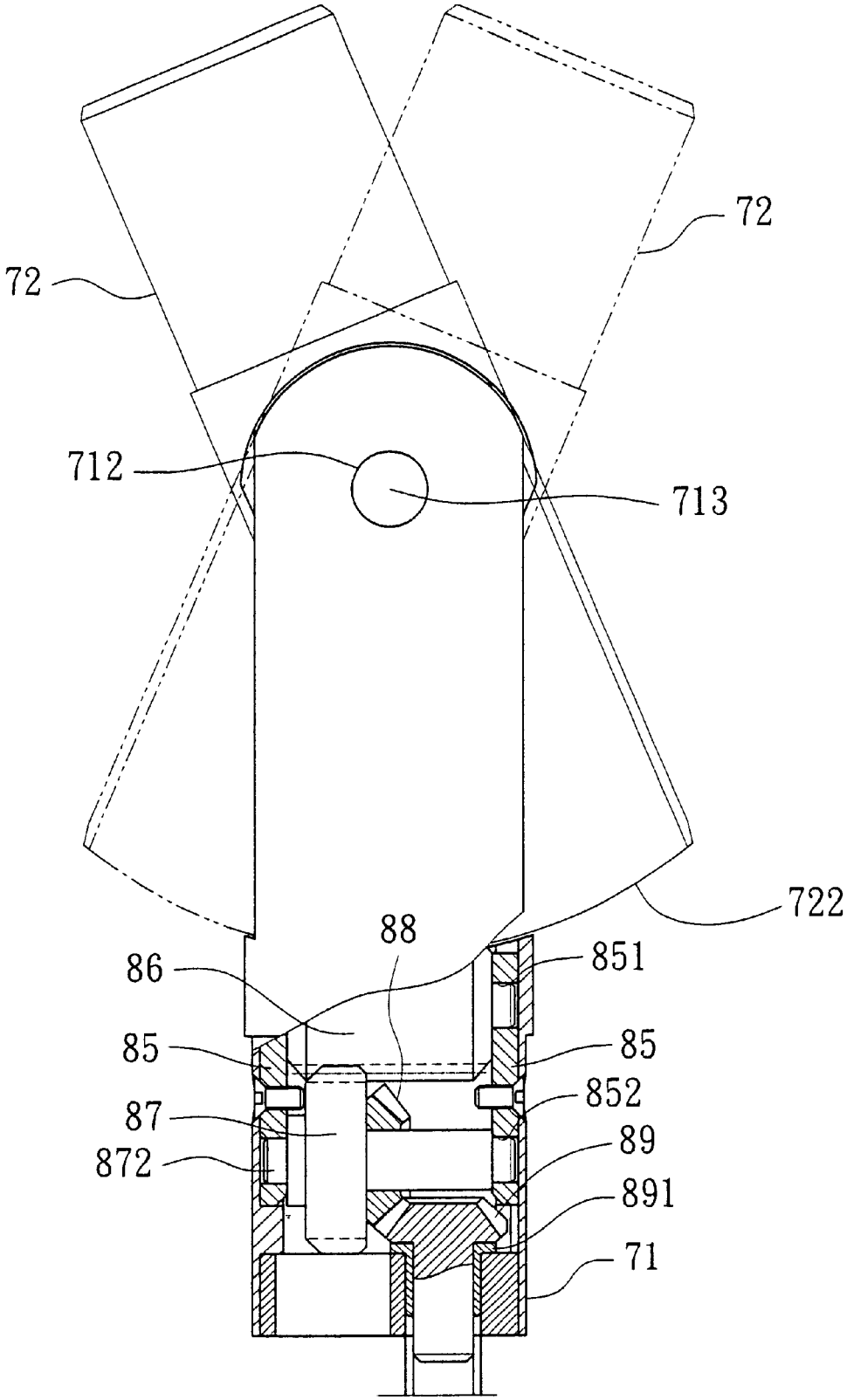
FIG. 8 is a sectional view showing the utilization of the direction-swinging device of the present invention.

Referring to FIGS. 7 and 8, the rolling device 2 is provided with a direction-swinging device 3 having a seat 71, a swinging head 72 and a triggering mechanism 80.

The seat 71 includes a slot 711 and a hole 712 through the slot 711, and the swinging head 72 is engaged with the slot 711, and the bottom end of the swinging head 72 is provided with teeth-like section 722 which can be pivotally mounted with a peg 713.

The trigger device 80 is within the seat 71 and has two fixing plates having a first fixing hole and a second fixing hole, the two fixing plates are mounted to the seat with a fixing element.

A worm gear 87 having two ends mounted with a pivot shaft mounted the two fixing plate to the first fixing hole and the worm gear 87 with a wheel shaft having a lathering face and is mounted with a conic shape gear 88 having a tangential hole 881, the tangential face of the hole 881 is corresponding to the lathering face for mounting, and the two ends of the worm gear 87 are provided with a pivotal shaft 872 for fixing to the second fixing hole 852.

As shown in FIGS. 7 and 11, an umbrella shape gear 49 is coupled to the lower section of the conic shape gear 49 to receive the rotating force transmitted from the rolling device 2, and the worm gear 87 and the umbrella gear 49 are coupled, and the umbrella gear 49 and the gear section at the bottom end of the swinging head 72 are coupled so that the umbrella panel 7 can be adjusted to swing in all direction.

Referring to FIGS. 7 and 11, a collar 491, 891 are positioned between the umbrella gear 49 and the transmission shaft 4 and the collars 491, 891 are secured at the recess 812 (as shown in FIG. 8) of the cord protection seat 81, and a peg 892 is disposed to the umbrella gear 49 for mounting to the end of the transmission shaft 4.

As shown in FIGS. 1 and 5, when the umbrella panel 7 is to be unfolded. The handle 25 is pushed in and the steel ball 383 limited at the first recess 373. The recess section 375 is mounted at the protruded section 32 and the user rotates the handle 25 and the handle 25 drives the shaft 31 to rotate. The pulling cord 8 is rolled and the umbrella panel 7 is stretched out.

Referring to FIGS. 5 and 10, the umbrella panel 7 is stopped when the handle 25 stops to rotate and a position of the umbrella panel 7 is obtained. The ratchet finger 51 is engaged with the single-direction ratchet wheel 35, facilitating the stopping section 60 to cause the shaft 31 to stop. Thus the umbrella panel 7 will not be self folded as a result of a strong wind.

When the umbrella is unfolding, the handle 25 is rotated. The single direction ratchet wheel 35 will not be engaged and the ratchet finger 51 is engaged with the wheel 35 if the rotation is reversed, the ratchet wheel 35 is released from the connecting section 34 so that the pulling cord 8 is released to retract the umbrella panel.

Referring to FIGS. 2, 6, and 8, if the user is to bend the umbrella panel 7, the handle 25 is pulled outward, and the steel ball 388 contained therein will limit the second recess 374 of the clutch shaft 37, and the recess section 375 is separated from the protruded section 32 and the gear 371 and the interlinking gear 46 are coupled. If the handle 25 is rotated again, the angle to the left and right is changed (at a maximum of 23 degree). The clutch shaft 37 is rotated, the gear 371 drives the interlinking gear 46 to cause the conic gear 44, the umbrella gear 49 and the transmission shaft 4 to rotate.

The worm gear 87 is rotated simultaneously with the conic gear 88. Therefore the rotating of the transmission shaft 4 rotates the triggering mechanism 80, and the worm wheel 86 is coupled to the teeth section 722 at the lower end of the swinging head 72. Thus the rotating of the handle 25 will cause a change of angle of the swinging head 72.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A dual direction-swinging device for an umbrella having a hollow shaft, rib and an umbrella panel mounted onto the top of the rib, characterized in that: the shaft is provided with a rolling device interlinked to the rib and the direction-swinging device having a seat, a swinging head and a triggering mechanism, the seat includes a slot and a hole through the slot, the swinging head is engaged with the slot the bottom end of the swinging head is provided with teeth-like section which can be pivotally mounted with a peg, the trigger device is within the seat and has two fixing plates having a first fixing hole and a second fixing hole, the two fixing plates are mounted to the seat with a fixing element; a worm gear having two ends mounted with a pivot shaft mounted the two fixing plate to the first fixing hole; a worm gear with a wheel shaft having a lathering face and is mounted with a conic shape gear having a tangential hole, the tangential face of the hole is corresponding to the lathering face for mounting, and the two ends of the worm gear are provided with a pivotal shaft for fixing to the second fixing hole, an umbrella shape gear is coupled to the lower section of the conic shape gear to receive the rotating force transmitted from the rolling device, the worm gear and the umbrella gear are coupled, and the umbrella gear and the gear section at the bottom end of the swinging head are coupled so that the umbrella panel can be adjusted to swing in all direction.

2. The umbrella structure of claim 1, wherein the seat is provided with a cord-protection seat.

3. The umbrella structure of claim 1, wherein the cord-protection seat is provided with a through hole and a recess is located near to the through hole.

4. The umbrella structure of claim 1, wherein the umbrella gear is provided with a transmission shaft at the lower section thereof to receive the rotating force from the rolling device.

5. The umbrella structure of claim 4, wherein the two ends of the transmission shaft are provided with an umbrella gear, and the transmission shaft is positioned between the rolling device and the direction-swinging device.

6. The umbrella structure of claim 1, wherein a collar is positioned between the umbrella gear and the transmission shaft and the collar is secured at the recess of the cord protection seat, and a peg is disposed to the umbrella gear for mounting to the end of the transmission shaft.

7. The umbrella structure of claim 1, further comprises a seat body linked with the umbrella shaft and having a rotating section provided with an interlinking section, and the rotating section drives the interlinking section and the shaft of the rotating section is connected with a pulling cord to unfolding the umbrella panel.

8. The umbrella structure of claim 7, wherein the seat body is provided with a first through hole, a second through hole for pivotal mounting with the rotating section and the interlinking section, and the first through hole near to the seat body is provided with a long hole having a stopping section.

9. The umbrella structure of claim 8, wherein the stopping section includes a ratchet finger, a blocking block, and an elastic element positioned between the ratchet finger and the blocking block.

10. The umbrella structure of claim 7, wherein the rotating section includes:

(a) a shaft pivotally mounted to the seat body and having one end provided with a protruded section, the protruded section being non circular face, the other end of the shaft is provided with a slot, and the protruded section is provided with a connecting section having a single direction ratchet wheel, the shaft is provided with a cord hole for mounting with a pulling cord connected to the umbrella stretcher;

(b) a clutch shaft having a gear with one end face extended to form a shaft center mounted with a first recess and a second recess, the other end face of the gear is provided with a protruded section to match with the recess, the end face of the shaft center is provided with a screw hole;

(c) a positioning seat having one end provided with a through hole for the passing through of the shaft center of the clutch, the circumferential edge of the through hole is provided with a long hole provided with a positioning element to urge the first recess and the second recess of the shaft center of the clutch shaft, the positioning seat is in combination with the a screw-element mounted to the seat body;

(d) a handle having a hole for mounting with the shaft section of the clutch shaft and a bolt being inserted so as to mount the handle at the end section of the shaft center;

(e) a delaying section having a pad, an elastic element and a stopping pad and a screw, the center of the pad and the stopping pad being an isolation plate and the pad and the stopping pad being mounted to the recess of the shaft by the isolation plate, and the screw nut mounted the pad, the elastic element and the stopping pad onto the recess of the shaft; and (f) a housing mounted at the external of the seat body and comprising two external shells, one of the shell being provided with a cap body having a corresponding hole for the extension out of the shaft center of the clutch shaft.

11. The umbrella structure of claim 10, wherein the circumferential edge of the protruded section is provided with a plurality of flat surfaces and the circumferential edge of the recess is provided with equal amount of flat surfaces so that the protruded sections and the recesses are matched.

12. The umbrella structure of claim 10, wherein one end of the shaft center is a square shaft section and the inner side of the handle is a squared shape hole for matching thereto.

13. The umbrella structure of claim 7, wherein the interlinking section includes:

(a) an interlinking shaft mounted to the seat body and one end thereof having a fixing section with a protruded edge, the side of the protruded edge being a plurality of recesses and the interlinking shaft having a lathering face, and the interlinking shaft mounted onto a conic gear having a tangential hole which corresponds to the lathering face of the interlinking shaft; and (b) an interlinking gear having a screw nut mounting to the interlinking shaft, and the protruded edges the interlinking gear and the interlinking shaft enclose steel balls and spring.

* * * * *